United States Patent [19]

Machnik

[11] 4,315,655

[45] Feb. 16, 1982

[54] HUNTER'S SEAT AND SLING

[76] Inventor: Edward I. Machnik, 3505 E. Michigan Ave., Jackson, Mich. 49201

[21] Appl. No.: 89,882

[22] Filed: Oct. 31, 1979

[51] Int. Cl.[3] ..... A45F 4/00

[52] U.S. Cl. ..... 297/118; 182/187; 297/217

[58] Field of Search ..... 182/187; 297/217, 118; 224/160, 159, 184, 254, 255, 257, 151, 158; 5/122

[56] References Cited

U.S. PATENT DOCUMENTS

| | | | |
|---|---|---|---|
| 2,722,968 | 11/1955 | Smith | 5/122 |
| 2,804,249 | 8/1957 | Manalo | 224/158 |
| 2,821,335 | 1/1958 | White | 297/217 X |
| 2,827,949 | 3/1958 | Kershaw . | |
| 2,847,059 | 8/1958 | Klins | 182/187 X |
| 3,038,644 | 6/1962 | Johnson | 224/184 |
| 3,077,292 | 2/1963 | Gehrke | 224/184 |
| 3,346,154 | 10/1967 | Bishop | 224/184 |
| 3,599,973 | 8/1971 | Ahrens . | |
| 3,700,278 | 10/1972 | Gulba | 297/217 X |
| 3,992,055 | 11/1976 | Shaw et al. | 297/217 |

*Primary Examiner*—James T. McCall
*Attorney, Agent, or Firm*—Beaman & Beaman

[57] ABSTRACT

A combination hunter's seat and hauling sling which is of a flexible construction permitting rolling or folding into a concise configuration as to be readily carried within a pocket. The sling includes a seat band member adjustably secured to a flexible cord adapted to be looped about a tree wherein the user may comfortably sit upon the band member. Further, placing the band member across the chest permits the apparatus to function as a sling for distributing a pulling load when hauling heavy game.

1 Claim, 4 Drawing Figures

HUNTER'S SEAT AND SLING

BACKGROUND OF THE INVENTION

Deer hunting requires the hunter to remain motionless while awaiting the quarry, and the hunter will normally be seated. Hunters sometimes carry a folding chair with them into the woods, and there are a number of cushions and portable seat devices for permitting the hunter to sit upon a log or stump in relative comfort, but such devices are bulky and not easily carried, especially on a long walk through underbrush.

Except for a folding chair, most hunting seat devices do not provide a back support, and back fatigue is a common problem while sitting upon a log, stump, rock, or the like. Also, a log, stump, or other support for the hunter may not be available at the desired location, and the hunter may find it necessary to stand for long periods of time, producing cramps and fatigue.

It is an object of the invention to provide a portable seat apparatus particularly suitable for hunters wherein the seat is of a light weight, foldable within a concise configuration, and may be readily attached to a tree trunk wherein the trunk serves to support the hunter's back as well as provide the means for supporting the seat.

A further object of the invention is to provide an inexpensive combination seat and sling which may be readily adjustable to permit use in a wide variety of situations, and wherein the apparatus may function either as a seat to support the hunter in a sitting position, and may also be used as a sling across the hunter's body when pulling a kill to camp.

In the practice of the invention an elongated flexible band member, preferably sewn of fabric, includes corner ends which are folded upon themselves in a triangular manner to define an apex. A strap is sewn to each apex constituting the support for a pair of rings which cooperate with a flexible cord or rope intertwined between the rings for adjustment thereto.

Upon looping the rope about a tree the rope may be adjustably secured to the rings to support the hunter's weight when sitting upon the band member, and the band member will accommodate itself to the configuration of the hunter, and the suspension of the band member will permit the tree trunk to function as a back support. As the hunter will be sitting in close proximity to the tree his visible profile is reduced as compared with sitting on a log or stump in open view, and yet the seat apparatus in no way interferes with the hunter's visibility.

After the kill has been made the band member may be placed across the hunter's chest and the cord affixed to the kill and the rings. In this manner, the kill may be comfortably dragged as the band member will distribute the pulling forces across the wearer's body in a relatively uniform manner eliminating localized pressure points.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
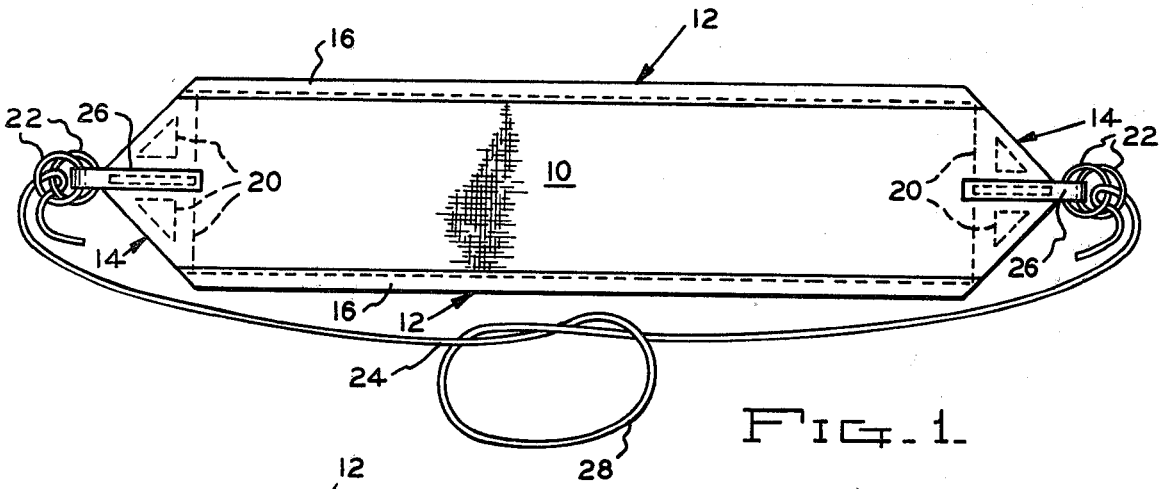
FIG. 1 is an elevational view of a combination hunter's seat and sling in accord with the invention, illustrating the cord in association with the rings.
Figure 2:
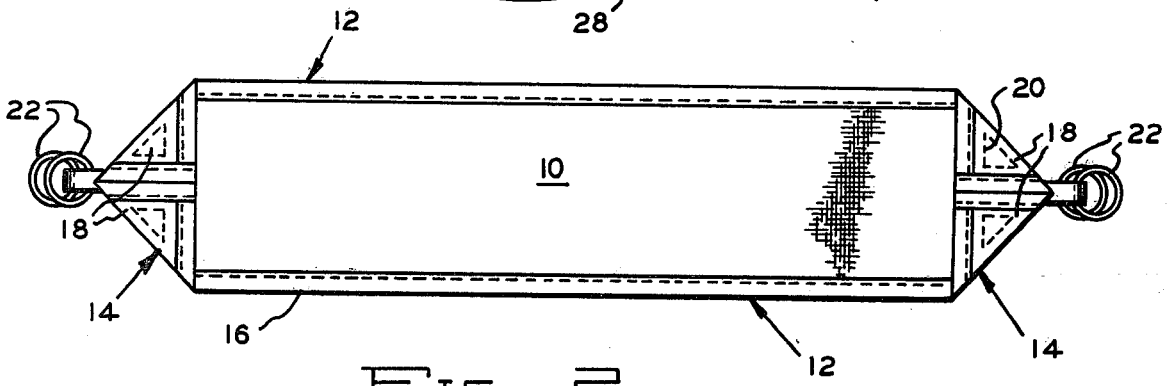
FIG. 2 is an elevational view of the opposite side of the band member, with the cord removed.

The primary component of the combination seat and sling of the invention is the band member 10 which is preferably formed of a heavy fabric, such as canvas or the like, but could be formed of other material such as leatherette, vinyl, etc. The member 10 is of an elongated configuration preferably having a length at least four times its width, and includes lateral edges 12, and end regions 14.

Preferably, the band member 10 is reinforced at the lateral edges by binding 16 which may be vinyl or synthetic material sewn to the edges. At the ends 14 the band material corners are folded over defining triangular portions 18, and these portions are sewn to the overlapped band material at 20. Thus, the end portions 14 define a pointed apex consisting of a pair of triangular portions 18 formed a double layer at the ends.

Each end of the band member 10 is provided with a pair of rings or loops 22 for cooperation with the flexible tension member 24 and the rings 22 are preferably supported in a loop defined in a nylon strap 26 folded over upon itself and sewn to the double layered band ends 14. Thus, the combination of the double layer strap 26, and the double layers of band material at the end regions, produce a high strength connection of the rings 22 upon the band member end.

The tension member 24 is, preferably, a rope or cord formed of braided nylon, and is usually of approximately ten feet in length. The cord is looped through rings 22 in such a manner as to permit the rings to tightly grip the cord when the cord is under tension, but permit the cord to be adjustably slipped through the ring when untensioned for adjustment purposes.

Figure 3:
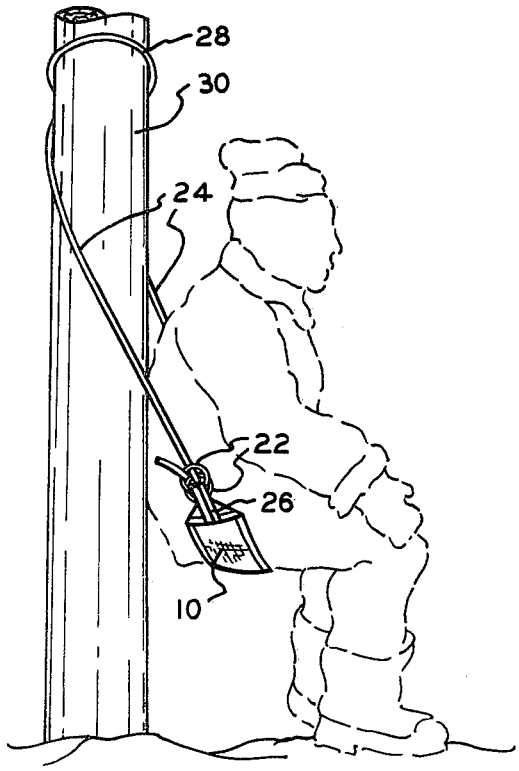
FIG. 3 is an elevational, perspective view of the apparatus of the invention as installed upon a tree and a hunter sitting thereon.

In use, the cord 24 will, initially, not be looped through the rings 22, but a loop 28, FIG. 1, will be formed therein, FIG. 1, around the tree trunk 30. Thereupon, the ends of the cord pass around the rear of the tree trunk and the ends thereof are adjustably located within the rings 22, FIG. 3. The cord 24 is adjusted relative to the rings 22 so that the band member 10 will be vertically located above the ground level at a height comfortable to the user. As will be appreciated from FIG. 3 the suspension of the cord from the opposite side of the tree with respect to the location of the hunter will naturally draw the seat toward the tree and permit the hunter to comfortably rest his back against the tree trunk. As the cord is located below the user's head the cords do not affect the visibility of the hunter while seated.

Figure 4:
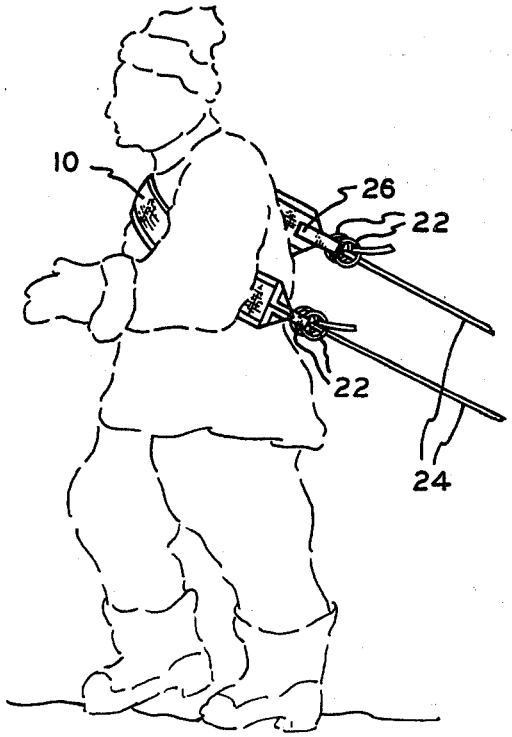
FIG. 4 is a perspective view of the invention as utilized as a sling for pulling game.

In FIG. 4, the band member 10 is illustrated as used as a sling extended across the chest of the user, and by fastening the cord 24 to the rings 22 the kill, not shown, may be comfortably dragged without imposing localized pressure points upon the wearer's chest. Of course, the band member may be slung over one shoulder, or passed across the chest under both arms, or across the stomach, as the user desires.

Because of the flexible nature of the band member 10 and the cord 24, the disclosed apparatus may be readily rolled or folded into a concise configuration and readily carried within the user's pocket. The economical construction of the apparatus makes the device economically feasible, and comfortable seating in the woods is attained.

It is appreciated that various modifications to the inventive concept may be apparent to those skilled in the art without departing from the spirit and scope of the invention.

I claim:

1. A combination hunter's seat and hauling sling characterized by its flexibility and ability to be concisely folded, comprising, in combination, an elongated, flexible, fabric band member having a length at least four times its width and having lateral edges and ends, the material of the ends of said band member being folded over on itself to define an apex at each end of double layers of band material centrally located between the band member lateral edges, a strap affixed to each apex of double layered band material defining a loop extending beyond the associated apex, adjustable holding means defined upon each end of said band member comprising a pair of rings loosely mounted within each strap loop, and a flexible cord adjustable associated with each pair of rings and looped therethrough wherein the location of attachment of said cord to said rings may be adjusted.

* * * * *